US006089555A

United States Patent [19]

Lin

[11] Patent Number: 6,089,555

[45] Date of Patent: Jul. 18, 2000

[54] WORKTABLE

[76] Inventor: Huang Lung Lin, No. 33-2, Pu Gang Road, Pu Yien Hsiang, Chang Hua Hsien, Taiwan

[21] Appl. No.: 09/258,914

[22] Filed: Mar. 1, 1999

[51] Int. Cl.[7] ..... B25B 1/10

[52] U.S. Cl. ..... 269/139; 269/244

[58] Field of Search ..... 269/139, 244, 269/208, 900, 901, 219–220; 108/130–132, 125, 127; 248/188

[56] References Cited

U.S. PATENT DOCUMENTS 4,157,174 6/1979 Hickman et al. ..... 269/139

4,364,548 12/1982 Eccardt ..... 269/139

5,681,034 10/1997 Noniewicz ..... 269/139

*Primary Examiner*—Robert C. Watson

*Attorney, Agent, or Firm*—Dougherty & Troxell

[57] ABSTRACT

A worktable includes two beams and two pairs of legs pivotally coupled to the beams for forming a foldable base. A plate is disposed on two seats and two fasteners may secure the plate and the seats on the beams. Two bolts are rotatably received in the beams and two slides are threaded with the bolts and slidably received in the beams. Two blocks are slidably disposed on the beams for supporting another plate, and two fasteners may secure the plate and the blocks to the slides for allowing the worktable to be easily assembled and disassembled.

5 Claims, 3 Drawing Sheets

WORKTABLE

BACKGROUND OF THE INVENTION

1. Field of the Invention

The present invention relates to a worktable, and more particularly to a worktable having an improved configuration for allowing the worktable to be easily assembled and disassembled.

2. Description of the Prior Art

Typical worktables comprise a base and a plate fixed on top of the base and a plate slidably engaged on top of the base and movable toward and away from the other plate. In order to secure the plates on top of the base, a number of securing fasteners are required for securing the worktable members together. The base and the plates comprise a complicated configuration and may not be easily assembled and disassembled.

The present invention has arisen to mitigate and/or obviate the afore-described disadvantages of the conventional worktables.

SUMMARY OF THE INVENTION

The primary objective of the present invention is to provide a worktable having a configuration that may be easily assembled and disassembled.

In accordance with one aspect of the invention, there is provided a worktable comprising two beams each including a cavity formed therein, two frames each including a pair of legs each having an upper portion pivotally coupled to the beams at a pivot shaft for allowing the legs to be rotated about the pivot shafts respectively and for allowing the legs to be folded toward and away from each other, the legs each including a middle portion, the frames each including a foldable link secured between the middle portions of the legs for limiting an opening size between the legs, the frames each including a bar secured between the legs thereof for securing the legs thereof in position, a pair of post secured between the frames for securing the the legs of the frames together, two seats secured on the beams respectively and each including two poles formed therein and each including a projection extended upward therefrom and each including a bulge extended downward therefrom for engaging into the cavity of the beam and for positioning the seats to the beams respectively, two blocks slidably supported on the beams respectively and each including two columns formed therein and each including a stop extended upward therefrom and each including a hole formed therein, a first plate secured on the seats and including two orifices formed therein for receiving the projections of the seats and for positioning the first plate to the seats, a pair of first fasteners engaged through the first plate and engaged through the seats respectively and engaged with the beams respectively for securing the first plate and the seats to the beams, a second plate secured on the blocks and including two openings formed therein for receiving the stops of the blocks and for positioning the second plate to the blocks, and means for moving the blocks along the beams respectively to move the second plate toward and away from the first plate.

The moving means includes two bolts rotatably received in the beams respectively, two slides slidably engaged in the beams and each including an inner thread engaged with the bolt for allowing the bolts to move the slides along the beams respectively when the bolts are rotated. The beams each includes a channel formed therein, the slides each includes a stud extended upward therefrom and slidably received in the channel of the beam for guiding the slide to move along the beam, the worktable further includes a pair of second fasteners engaged through the second plate and engaged through the seats respectively and engaged with the studs of the slides respectively for securing the second plate and the blocks to the slides.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
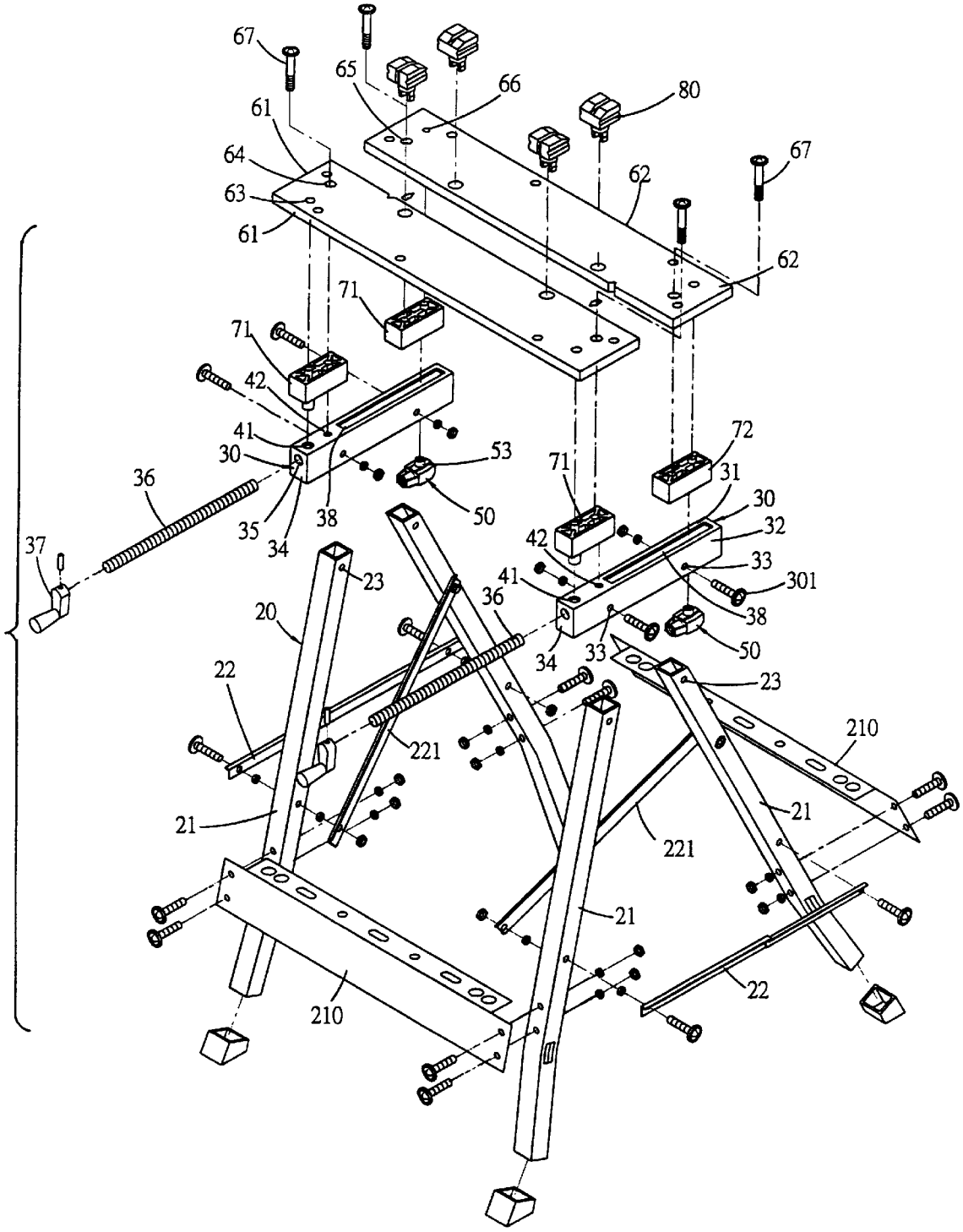
FIG. 1 is an exploded view of a worktable in accordance with the present invention.
Figure 2:
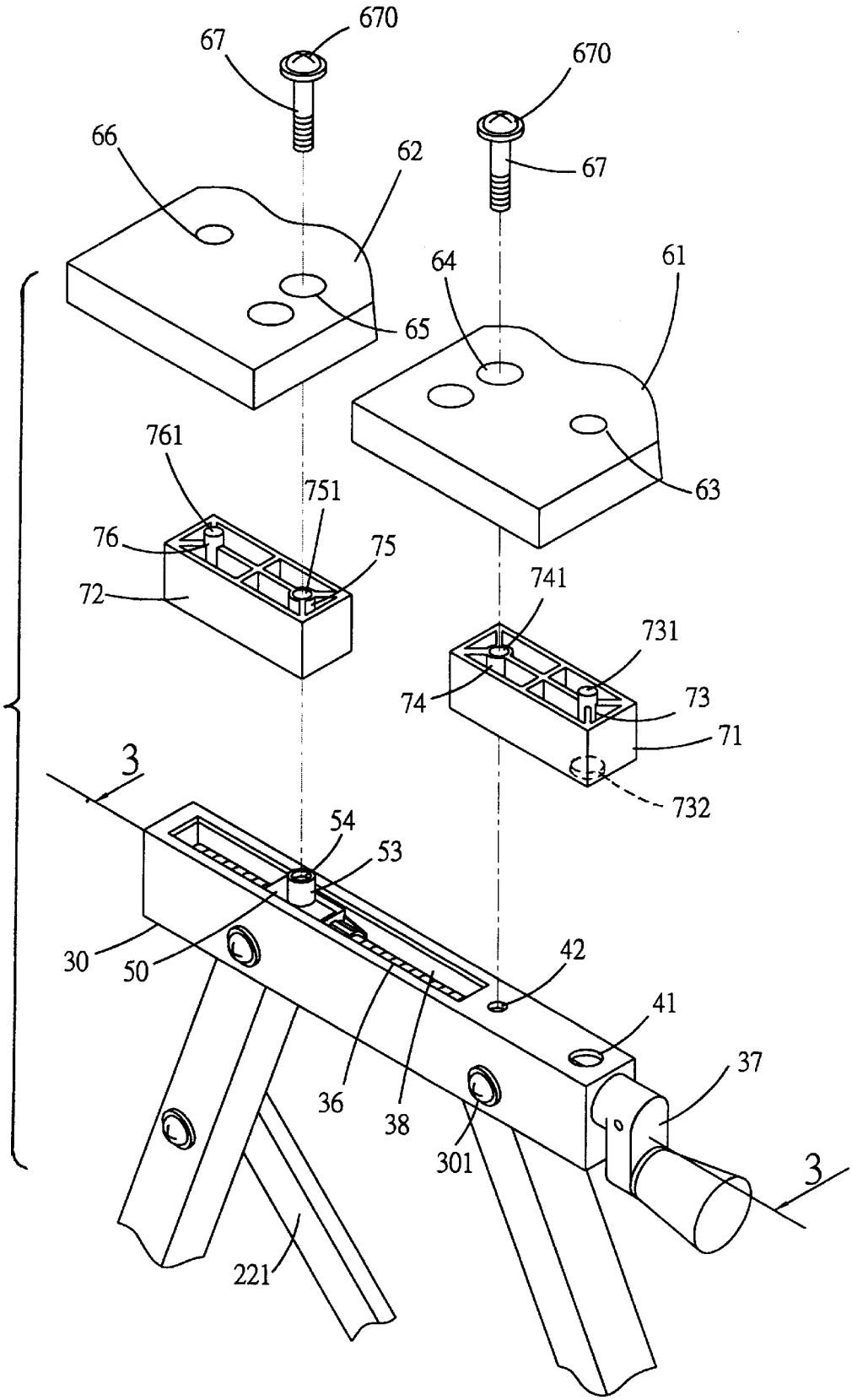
FIG. 2 is a partial exploded view of the worktable.

Referring to the drawings, a worktable in accordance with the present invention comprises two frames 20 each having a pair of legs 21. The legs 21 of each of the frames 20 include an upper portion pivotally coupled to a pair of beams 30 at a pivot shaft 301 respectively and each include a middle portion coupled together by a foldable link 22. The pivot shafts 301 are engaged through the holes 23 of the legs 21 and threaded with the holes 33 that are formed in the side portions 32 of the beams 30. The foldable links 22 are provided for allowing the pairs of legs 21 to be folded relative to each other about the pivot shafts 301 and for limiting the opening size between the legs 21. A pair of bars 221 are further secured between the legs 21 for solidly securing the legs 21 in position and for forming a stable structure for the frames 20. A pair of post 210 are secured between the frames 20 for securing the legs 21 of the frames 20 together. The bars 221 each includes one end that should be disengaged from the legs 21 for allowing the legs 21 to be folded toward and away from each other.

The beams 30 each includes an upper portion 31 having a cavity 41 and an aperture 42 and a channel 38 formed therein and each includes a front portion 34 having a hole 35 formed therein for receiving a bolt 36 which is rotatably secured in the respective beam 30. The bolts 36 each includes a handle 37 secured to one end thereof for rotating the bolts 36. Two slides 50 each includes a screw hole 52 (FIG. 3) formed therein for threading with the bolts 36 respectively, and each includes a stud 53 extended upward and preferably slidably engaged in the channel 38 of the beam 30 for guiding the slides 50 to move along the beams 30 respectively and for preventing the slides 50 from rotating relative to the beams 30. The studs 53 each includes a screw hole 54 formed therein for threading with a fastener 67. The slides 50 may be forced to slide along the respective beams 30 when the bolts 36 are rotated by the respective handle 37.

Two seats 71 each includes two poles 73, 74 formed therein and each includes a projection 731 extended upward from the pole 73 thereof and each includes a bulge 732 extended downward from the pole 73 for engaging into the cavity 41 of the beam 30. The pole 74 includes a hole 741 formed therein for receiving a fastener 67. A single fastener 67 is good enough to secure the seat 71 to the beam 30 due to the engagement of the bulge 732 of the seat 71 in the cavity 41 of the beam 30. Two blocks 72 each includes two columns 75, 76 formed therein and each includes a stop 761 extended upward from the column 76 thereof and each includes a hole 751 formed in the column 75 for receiving the fastener 67.

A first plate 61 is secured on top of the seats 71 and includes two orifices 63 for receiving the projections 731 of the seats 71 and includes two step holes 64 formed therein for receiving the fasteners 67 and for receiving the heads 670 of the fasteners 67, such that the plate 61 and the seats 71 may be easily secured to the beam 30 with a pair of fasteners 67. A second plate 62 is secured on top of the blocks 72 and includes two openings 66 for receiving the stops 761 of the blocks 72 and includes two step holes 65 formed therein for receiving the fasteners 67 and for receiving the heads 670 of the fasteners 67, such that the plate 62 and the blocks 72 may be easily and solidly secured to the slides 50 respectively with a pair of fasteners 67. A number of brackets 80 (FIG. 1) may further be secured on top of the plates 61, 62 for engaging with the workpieces and for retaining the workpieces on the plates 61, 62.

Figure 3:
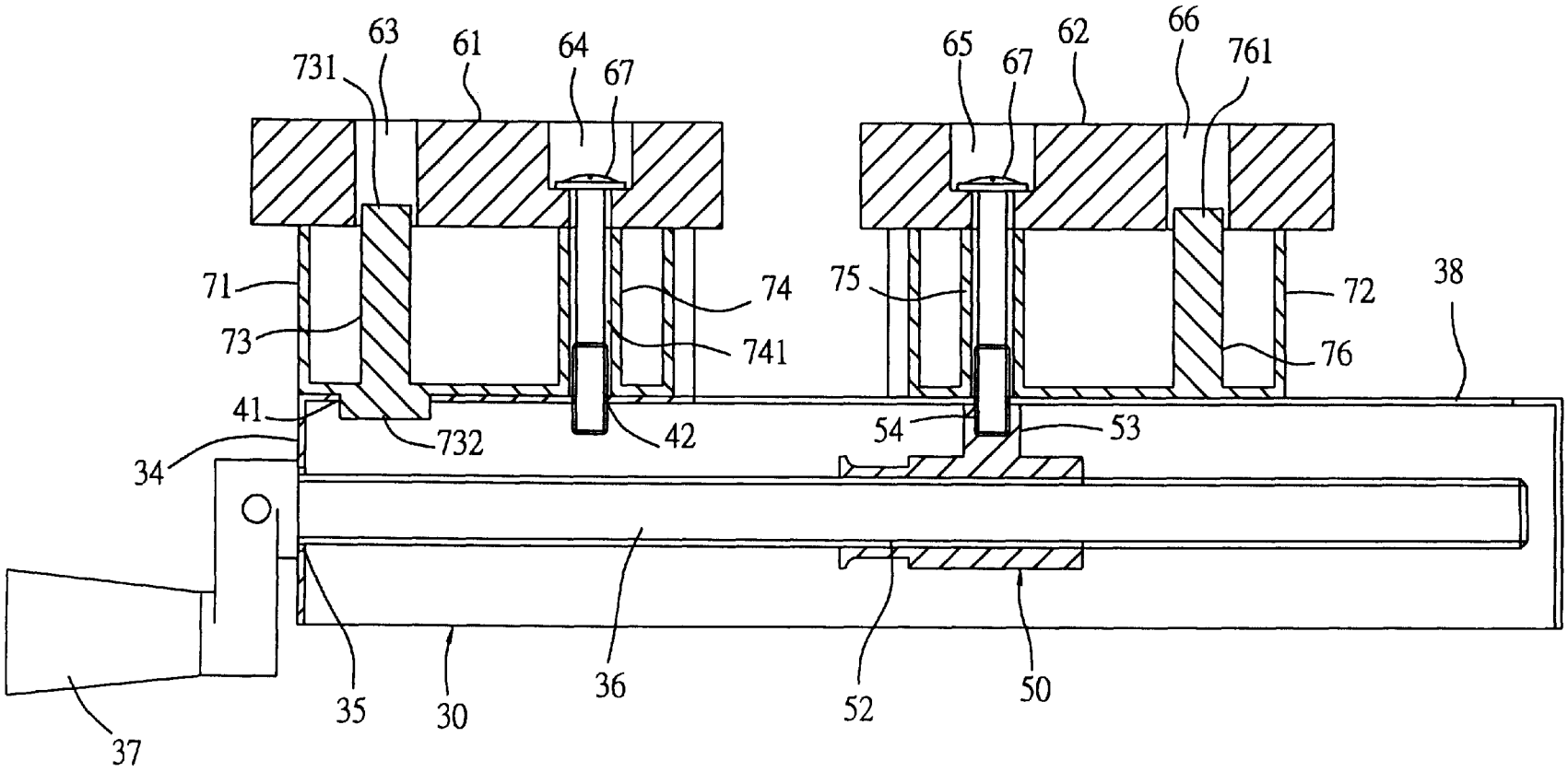
FIG. 3 is a cross sectional view of the worktable, taken along lines 3—3 of FIG. 2, after the elements and members are assembled together.

In operation, as shown in FIG. 3, the plate 62 and the slides 50 may be easily moved along the beams 30 by rotating the bolts 36 with the handles 37, according to the sizes of the workpieces to be supported on top of the plates 61, 62, such that the plate 62 may be easily moved toward and away from the plate 61. The plates 61, 62 and the seats 71 and the blocks 72 may be easily and solidly secured in place with four fasteners 67 only, such that the members and elements of the worktable may be easily and quickly assembled and disassembled. This benefits the users of the worktables a lot.

Accordingly, the worktable in accordance with the present invention includes a configuration that may be easily assembled and disassembled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A worktable comprising:

two beams each including a cavity formed therein, two frames each including a pair of legs each having an upper portion pivotally coupled to said beams at a pivot shaft for allowing said legs to be rotated about said pivot shafts respectively and for allowing said legs to be folded toward and away from each other, said legs each including a middle portion, said frames each including a foldable link secured between said middle portions of said legs for limiting an opening size between said legs, said frames each including a bar secured between said legs thereof for securing said legs thereof in position, a pair of post secured between said frames for securing said said legs of said frames together, two seats secured on said beams respectively and each including two poles formed therein and each including a projection extended upward therefrom and each including a bulge extended downward therefrom for engaging into said cavity of said beam and for positioning said seats to said beams respectively, two blocks slidably supported on said beams respectively and each including two columns formed therein and each including a stop extended upward therefrom and each including a hole formed therein, a first plate secured on said seats and including two orifices formed therein for receiving said projections of said seats and for positioning said first plate to said seats, a pair of first fasteners engaged through said first plate and engaged through said seats respectively and engaged with said beams respectively for securing said first plate and said seats to said beams, a second plate secured on said blocks and including two openings formed therein for receiving said stops of said blocks and for positioning said second plate to said blocks, and means for moving said blocks along said beams respectively to move said second plate toward and away from said first plate.

2. The worktable as claimed in claim 1, wherein said moving means includes two bolts rotatably received in said beams respectively, two slides slidably engaged in said beams and each including an inner thread engaged with said bolt for allowing said bolts to move said slides along said beams respectively when said bolts are rotated.

3. The worktable as claimed in claim 2 further comprising means for securing said second plate and said blocks to said slides respectively.

4. The worktable as claimed in claim 2, wherein said beams each includes a channel formed therein, said slides each includes a stud extended upward therefrom and slidably received in said channel of said beam for guiding said slide to move along said beam, said worktable further includes a pair of second fasteners engaged through said second plate and engaged through said seats respectively and engaged with said studs of said slides respectively for securing said second plate and said blocks to said slides.

5. The worktable as claimed in claim 2 further comprising means for rotating said bolts in said beams respectively.

* * * * *